US006248709B1

(12) United States Patent
Kandasamy et al.

(10) Patent No.: US 6,248,709 B1
(45) Date of Patent: Jun. 19, 2001

(54) PROCESS FOR MAKING A DETERGENT COMPOSITION BY ADDING CO-SURFACTANTS

(75) Inventors: Manivannan Kandasamy, Higashinada-ku; Kenji Naemura, Ibo-gun, both of (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/380,038

(22) PCT Filed: Feb. 27, 1997

(86) PCT No.: PCT/US97/03064

§ 371 Date: Aug. 25, 1999

§ 102(e) Date: Aug. 25, 1999

(87) PCT Pub. No.: WO98/38279

PCT Pub. Date: Sep. 3, 1998

(51) Int. Cl.[7] ..... C11D 11/00; C11D 1/37; C11D 17/06

(52) U.S. Cl. ..... 510/444; 510/351; 510/352; 510/438; 510/445

(58) Field of Search ..... 510/445, 438, 510/444, 351, 352

(56) References Cited

U.S. PATENT DOCUMENTS

| | | | | |
|---|---|---|---|---|
| 4,917,812 | * | 4/1990 | Cilley | 252/99 |
| 5,366,652 | * | 11/1994 | Capeci et al. | 252/89.1 |
| 5,486,303 | * | 1/1996 | Capeci et al. | 252/89.1 |
| 5,597,794 | * | 1/1997 | Bauer et al. | 510/457 |
| 5,792,040 | * | 10/1999 | Moss et al. | 8/137 |
| 5,962,393 | * | 10/1999 | Blum et al. | 510/395 |
| 5,968,892 | * | 10/1999 | Hutchins | 510/447 |

* cited by examiner

*Primary Examiner*—Mark Kopec
*Assistant Examiner*—Brian P. Mruk
(74) *Attorney, Agent, or Firm*—Brian M. Bolam; Kim William Zerby; Steven W. Miller

(57) ABSTRACT

A process for continuously preparing a free flowing agglomerate having a reduced level of resulting undesirable oversized granules is provided. The process comprises the steps of (a) thoroughly mixing a crystalline anionic surfactant paste with a sufficient amount of fine powders of starting detergent materials to form a free flowing agglomerate, then (b) thoroughly mixing a product of the step (a) with a non-crystalline anionic surfactant paste so as to form a free flowing agglomerate.

2 Claims, No Drawings

PROCESS FOR MAKING A DETERGENT COMPOSITION BY ADDING CO-SURFACTANTS

FIELD OF THE INVENTION

The present invention generally relates to a process for producing a detergent composition. More particularly, the invention is directed to a non-tower process during which detergent granules are produced by adding co-surfactants. The process produces a free flowing, detergent composition whose density can be adjusted for wide range of consumer needs, and which can be commercially sold.

BACKGROUND OF THE INVENTION

Recently, there has been considerable interest within the detergent industry to produce modern detergent compositions for flexibility in the ultimate density of the final composition.

Generally, there are three primary types of processes by which detergent granules or powders can be prepared. The first type of process involves spray-drying an aqueous detergent slurry in a spray-drying tower to produce highly porous detergent granules (e.g., tower process for low density detergent compositions). The second type of process involves spray-drying an aqueous detergent slurry in a spray-drying tower as the first step, then, the resultant granules are agglomerated with a binder such as a nonionic or anionic surfactant, finally, various detergent components are dry mixed to produce detergent granules (e.g., tower process plus non-tower [agglomeration] process for high density detergent compositions). In the third type of process, the various detergent components are dry mixed after which they are agglomerated with a binder such as a nonionic or anionic surfactant, to produce high density detergent compositions (e.g., non-tower [agglomeration] process for high density detergent compositions). In the above three processes, the important factors which govern the density of the resulting detergent granules are the shape, porosity and particle size distribution of said granules, the density of the various starting materials, the shape of the various starting materials, and their respective chemical composition.

It is often desirable, for performance reasons, to use a mixture of surfactants. Such surfactants are typically prepared in the form of aqueous pastes (typically 25–70% active). When preparing agglomerated granules from mixtures of such surfactant pastes, there are two approaches generally used. One typical approach is; surfactants in the form of paste are mixed so as to form a co-surfactant paste, followed by agglomerating the paste in a mixer, or in a series of mixers with dry ingredients such as builders (e.g. sodium tripolyphosphate), inorganic fillers (e.g. sodium sulfate), bleaches, etc. This approach is not always desirable in terms of finished product quality. For example, mixing of even a relatively small amount of a non-crystalline surfactant paste, (i.e. the paste of a type of surfactant which is typically sticky and difficult to be applied in an agglomeration process), with a paste of a crystalline surfactant, (i.e. a type which is typically easy to apply in an agglomeration process), results in a co-surfactant paste that has the nature of paste of a non-crystalline surfactant. In other words, this type of approach typically causes stickiness of a co-surfactant paste, when co-surfactants include a non-crystalline surfactant, since such non-crystalline surfactant is generally sticky. Consequently, the granules made by this approach generally include a large amount of undesirable oversized agglomerates. Some reduction in the amount of oversize agglomerates can be achieved by using relatively large amounts of flow aids such as zeolites and silicates in the agglomeration step. This, however results in added expense. Another typical approach is, each type of surfactant is formulated into separate agglomerates and then both agglomerates are blended. This approach typically is not desirable since the cost for the parallel agglomeration is rather expensive.

Accordingly, there remains a need in the art to have a process for producing a detergent composition which reduces the level of resulting undesirable oversized agglomerates, when starting detergent materials include a co-surfactant which is non-crystalline. Also, there remains a need for such a process which is more efficient, flexible and economical to facilitate large-scale production of detergents for flexibility in the ultimate density of the final composition.

BACKGROUND ART

The following references are directed to densifying spray-dried granules: Appel et al, U.S. Pat. No. 5,133,924 (Lever); Bortolotti et al, U.S. Pat. No. 5,160,657 (Lever); Johnson et al, British patent No. 1,517,713 (Unilever); and Curtis, European Patent Application 451,894.

The following references are directed to producing detergents by agglomeration: Beerse et al, U.S. Pat. No. 5,108,646 (Procter & Gamble); Capeci et al, U.S. Pat. No. 5,366,652 (Procter & Gamble); Hollingsworth et al, European Patent Application 351,937 (Unilever); and Swatling et al, U.S. Pat. No. 5,205,958.

The Japanese Patent Application, Laid-open No H5-171199 (Lion), describes a high bulk density granular detergent composition comprising a fatty acid lower alkyl ester sulfonate ("Co-surfactant I") and an anionic surfactant other than Co-surfactant I, silicate, and carbonate. This composition is disclosed as preventing the hydrolysis of Co-surfactant I after long term shortage.

SUMMARY OF THE INVENTION

The present invention meets the aforementioned needs in the art by providing a non-tower process, especially agglomeration process, which produces a granular detergent composition having ultimate density of the final granular composition. The present process is stable in terms of flow ability and cost effective, since the process reduces the level of undesirable oversized granules and/or the level of process flow aids, such as zeolites and/or silicates, that prevent over agglomeration. Consequently, the process of the present invention is more efficient, economical and flexible with regard to obtaining detergent compositions having less oversized granules (i.e., agglomerates).

As used herein, the term "agglomerates" refers to particles formed by agglomerating raw materials with binder such as surfactants and or inorganic solutions/organic solvents and polymer solutions. As used herein, the term "crystalline (anionic) surfactant paste" refers to the (anionic) surfactant paste having crystalline structure, generally having about 50–100%, preferably about 65–100%, more preferably about 80–100% of crystallinity, measured by X-Ray Diffraction (XRD). As used herein, the term "non-crystalline (anionic) surfactant paste" refers to the (anionic) surfactant paste which is not crystalline (anionic) surfactant paste defined as the above. All percentages used herein are expressed as "percent-by-weight" unless indicated otherwise.

The present invention provides a process for preparing a granular detergent composition, the process comprising: (a)

thoroughly mixing a crystalline anionic surfactant paste with a sufficient amount of fine powders of starting detergent materials form a free flowing agglomerate; (b) thoroughly mixing a product of the step (a) with a non-crystalline anionic surfactant paste to form a free flowing agglomerate; is provided. An agglomerate from the process of the present invention has a reduced level of resulting undesirable oversized granules.

Also provided are the granular detergent compositions produced by any one of the process embodiments described herein.

Accordingly, it is an object of the invention to provide a process for continuously producing a free flowing agglomerate, which reduces the level of resulting undesirable oversized granules. It is also an object of the invention to provide a process which is more efficient, flexible and economical to facilitate large-scale production of detergents of low as well as high dosage levels. These and other objects, features and attendant advantages of the present invention will become apparent to those skilled in the art from a reading of the following detailed description of the preferred embodiment and the appended claims.

DETAILED DESCRIPTION OF THE PREFERRED EMBODIMENT

The present invention is directed to a process which produces free flowing, granular detergent composition by controlling stickiness derived from a non-crystalline surfactant paste.

Process

First Step

In the first step of the process, a crystalline anionic surfactant paste and finely powdered detergent ingredients (hereinafter, fine powders), such as builders, are fed into an mixing equipment and then are agglomerated by dispersing the surfactant paste onto the fine powders, so as to form a free flowing agglomerate. Optionally, other starting detergent materials can be also fed into the equipment in this step. In this step, the amount of fine powders required to the first step depends on the amount of the crystalline anionic surfactant paste and the water content of the paste.

The examples of the equipment for the first step can be any types of equipment for agglomeration known to those skilled in the art. A suitable example can be a mixer, such as Lödige CB Mixer, Lödige KM Mixer, or Drais K-TTP.

Condition of agglomeration including time period for the first step depends on the type of equipment used for the first step, so as to produce an agglomerated homogeneous mixture. Such conditions can also be decided based on the design of final composition from the process of the present invention.

Second Step

In the second step of the process, the resultant from the first step, a non-crystalline anionic surfactant paste and fine powders are further mixed together so as to form a free flowing agglomerate. Optionally, other starting detergent materials can be also fed into the equipment in this step. In this step, the amount of fine powders required to the second step depends on the amount of the anionic surfactant paste (i.e., unreacted paste in the first step and the non-crystalline anionic surfactant paste), and the water content in the paste. Optionally, fine powders can be added to the second process.

In the second step of the process, a non-crystalline anionic surfactant paste is added to a resultant from the first step, subsequently, the paste and the resultant are further agglomerated so as to form granulates/agglomerates. In the second step, fine powders, either used in the first step or other fine powders, can be additionally added to the resultant.

The second step can be undertaken in the equipment for the first step or in another (second) equipment for agglomeration. The examples of the equipment can be any types of mixers known to those skilled in the art. A suitable example can be a mixer, such as Schugi Flexomic Model, Lödige CB Mixer, Lödige KM Mixer or Drais K-T. Generally, the process of the present invention allows the mixed crystalline anionic surfactant paste from the first step to stand for at least about 0.1 seconds prior to adding the non-crystalline anionic surfactant paste in the second step.

The agglomerated materials during the second step, which includes the anionic crystalline surfactant paste and the anionic non-crystalline surfactant paste, has a nature similar to agglomerates formed from crystalline anionic surfactant paste, namely, less amount of over sized agglomerates than agglomerates formed from non-crystalline anionic surfactant paste or formed from a mixture of crystalline surfactant paste and morphous anionic surfactant paste. Consequently, the second step can be undertaken smoothly since the agglomerated material has less amount of over sized agglomerates. Generally, the agglomerates from the present process include less than 20% of particles whose diameter is larger than 1180 $\mu$m. Preferably, the agglomerates from the present process include less than 15% of particles whose diameter is larger than 1180 $\mu$m. More preferably, the agglomerates from the present process include less than 10% of particles having diameter larger than about 1180 $\mu$m.

The resultant from the second step can be processed for further agglomeration which is well known to those skilled in the art.

In the present invention, the amount (as an active weight ratio) of the fine powders to the amount of crystalline anionic surfactant in the paste can be from about 2.0% to about 3.2%, preferably, from about 2.4% to about 2.8%.

In the present invention, the amount (as an active weight ratio) of the crystalline anionic surfactant in the paste to the amount of the non-crystalline anionic surfactant in the paste can be from about 4% to about 14%, preferably, from about 6% to about 12%, more preferably, from about 8% to about 10%.

Starting Detergent Materials

Starting detergent materials for granular detergent composition which is made according to the process of the present invention, except for crystalline anionic surfactant (s), non-crystalline anionic surfactant(s) and fine powders for the present invention, can be added anytime during or after the above two steps. Such other starting detergent materials fully described below.

Detergent Surfactant (Aqueous/Non-aqueous)

The total amount of detergent surfactant (i.e., crystalline anionic surfactant(s), non-crystalline anionic surfactant(s) and other surfactants for the final product from the present invention) which can be used for the present process can be from about 5% to about 60%, more preferably from about 12% to about 40%, more preferably, from about 15% to about 35%, in total amount of the final product obtained by the process of the present invention.

The surfactant itself is preferably selected from anionic, nonionic, zwitterionic, ampholytic and cationic classes and compatible mixtures thereof. Detergent surfactants useful herein are described in U.S. Pat. No. 3,664,961, Norris, issued May 23, 1972, and in U.S. Pat. No. 3,929,678, Laughlin et al., issued Dec. 30, 1975, both of which are incorporated herein by reference. Useful cationic surfactants also include those described in U.S. Pat. No. 4,222,905, Cockrell, issued Sep. 16, 1980, and in U.S. Pat. No. 4,239, 659, Murphy, issued Dec. 16, 1980, both of which are also incorporated herein by reference. Of the surfactants, anionics and nonionics are preferred and anionics are most preferred.

Nonlimiting examples of the preferred anionic surfactants useful in the present invention include the conventional $C_{11}$–$C_{18}$ alkyl benzene sulfonates ("LAS"), primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $Ch_3$ $(CH_2)y(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, and the $C_{10}$–$C_{18}$ alkyl alkoxy sulfates ("$AE_xS$"; especially EO 1–7 ethoxy sulfates).

Useful anionic surfactants also include water-soluble salts of 2-acyloxyalkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

Among these anionic surfactants, the preferable examples as crystalline anionic surfactant paste(s) of the present invention include; either natural or synthetic alkyl sulfates, preferably, $C_{12}$–$C_{18}$ coconut fatty alcohol sulfates or $C_{14}$–$C_{15}$ synthetic alkyl sulfates. The preferable examples as non-crystalline anionic surfactant paste(s) of the present invention include; alkyl alkoxy sulfates ($AE_xS$), alkyl benzene sulfonates (LAS).

Optionally, other exemplary surfactants useful in the paste of the invention include $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and the corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Cationic surfactants can also be used as a detergent surfactant herein and suitable quaternary ammonium surfactants are selected from mono $C_6$–$C_{16}$, preferably $C_6$–$C_{10}$ N-alkyl or alkenyl ammonium surfactants wherein remaining N positions are substituted by methyl, hydroxyethyl or hydroxypropyl groups.

Ampholytic surfactants can also be used as a detergent surfactant herein, which include aliphatic derivatives of heterocyclic secondary and tertiary amines; zwitterionic surfactants which include derivatives of aliphatic quaternary ammonium, phosphonium and sulfonium compounds; water-soluble salts of esters of alpha-sulfonated fatty acids; alkyl ether sulfates; water-soluble salts of olefin sulfonates; beta-alkyloxy alkane sulfonates; betaines having the formula $R(R^1)_2N^+R^2COO^-$, wherein R is a $C_6$–$C_{18}$ hydrocarbyl group, preferably a $C_{10}$–$C_{16}$ alkyl group or $C_{10}$–$C_{16}$ acylamido alkyl group, each $R^1$ is typically $C_1$–$C_3$ alkyl, preferably methyl and $R_2$ is a $C_1$–$C_5$ hydrocarbyl group, preferably a $C_1$–$C_3$ alkylene group, more preferably a $C_1$–$C_2$ alkylene group. Examples of suitable betaines include coconut acylamidopropyidimethyl betaine; hexadecyl dimethyl betaine; $C_{12-14}$ acylamidopropylbetaine; $C_{8-14}$ acylamidohexyldiethyl betaine; 4[$C_{14-16}$ acylmethylamidodiethylammonio]-1- carboxybutane; $C_{16-18}$ acylamidodimethylbetaine; $C_{12-16}$ acylamidopentanediethylbetaine; and $C_{12-16}$ acylmethylamidodimethylbetaine. Preferred betaines are $C_{12-18}$ dimethylammonio hexanoate and the $C_{10-18}$ acylamidopropane (or ethane) dimethyl (or diethyl) betaines; and the sultaines having the formula $(R(R^1)_2N^+R^2SO_3$— wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12}$–$C_{14}$ amido propyl ammonio-2-hydroxypropyl sultaine, $C_{12}$–$C_{14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

Fine Powders

The fine powders of the present process preferably selected from the group consisting of ground soda ash, powdered sodium tripolyphosphate (STPP), hydrated tripolyphosphate, ground sodium sulphates, aluminosilicates, crystalline layered silicates, nitrilotriacetates (NTA), phosphates, precipitated silicates, polymers, carbonates, citrates, powdered surfactants (such as powdered alkane sulfonic acids) and recycle fines occurring from the process of the present invention, wherein the average diameter of the powder is from 0.1 to 500 microns, preferably from 1 to 300 microns, more preferably from 5 to 100 microns. In the case of using hydrated STPP as the fine powders of the present invention, STPP which is hydrated to a level of not less than 50% is preferable. The aluminosilicate ion exchange materials used herein as a detergent builder preferably have both a high calcium ion exchange capacity and a high exchange rate. Without intending to be limited by theory, it is believed that such high calcium ion exchange rate and capacity are a function of several interrelated factors which derive from the method by which the aluminosilicate ion exchange material is produced. In that regard, the aluminosilicate ion exchange materials used herein are preferably produced in accordance with Corkill et al, U.S. Pat. No. 4,605,509 (Procter & Gamble), the disclosure of which is incorporated herein by reference.

Preferably, the aluminosilicate ion exchange material is in "sodium" form since the potassium and hydrogen forms of the instant aluminosilicate do not exhibit as high of an exchange rate and capacity as provided by the sodium form. Additionally, the aluminosilicate ion exchange material preferably is in over dried form so as to facilitate production of crisp detergent agglomerates as described herein. The aluminosilicate ion exchange materials used herein preferably have particle size diameters which optimize their effectiveness as detergent builders. The term "particle size diameter" as used herein represents the average particle size diameter of a given aluminosilicate ion exchange material as determined by conventional analytical techniques, such as microscopic determination and scanning electron microscope (SEM). The preferred particle size diameter of the aluminosilicate is from about 0.1 micron to about 10 microns, more preferably from about 0.5 microns to about 9 microns. Most preferably, the particle size diameter is from about 1 microns to about 8 microns.

Preferably, the aluminosilicate ion exchange material has the formula $$Na_z[(AlO_2)_z.(SiO_2)_y]xH_2O$$

wherein z and y are integers of at least 6, the molar ratio of z to y is from about 1 to about 5 and x is from about 10 to about 264. More preferably, the aluminosilicate has the formula $$Na_{12}[(AlO_2)_{12}.(SiO_2)_{12}]xH_2O$$

wherein x is from about 20 to about 30, preferably about 27. These preferred aluminosilicates are available commercially, for example under designations Zeolite A, Zeolite B and Zeolite X. Alternatively, naturally-occurring or synthetically derived aluminosilicate ion exchange materials suitable for use herein can be made as described in Krummel et al, U.S. Pat. No. 3,985,669, the disclosure of which is incorporated herein by reference.

The aluminosilicates used herein are further characterized by their ion exchange capacity which is at least about 200 mg equivalent of $CaCO_3$ hardness/gram, calculated on an anhydrous basis, and which is preferably in a range from about 300 to 352 mg equivalent of $CaCO_3$ hardness/gram. Additionally, the instant aluminosilicate ion exchange materials are still further characterized by their calcium ion exchange rate which is at least about 2 grains $Ca^{++}$/gallon/minute/-gram/gallon, and more preferably in a range from about 2 grains $Ca^{++}$/gallon/minute/-gram/gallon to about 6 grains $Ca^{++}$/gallon/minute/ gram/gallon.

Liquid Polymers

The starting detergent material for the present process can include liquid polymers. The liquid polymers can be selected from aqueous or non-aqueous polymer solutions, water and mixtures thereof. The amount of liquid polymers of the present process can be lower than about 10% (active basis), preferably lower than about 6% (active basis) in total amount of the final product obtained by the process of the present invention.

Preferable examples of the aqueous or non-aqueous polymer solutions which can be used in the present inventions are modified polyamines which coprise a polyamine backbone corresponding to the formula:

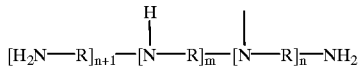

having a modified polyamine formula $V_{(n+1)}W_mY_nZ$ or a polyamine backbone corresponding to the formula:

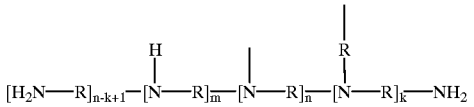

having a modified polyamine formula $V_{(n-k+1)}W_mY_nY'_kZ$, wherein k is less than or equal to n, said polyamine backbone prior to modification has a molecular weight greater than about 200 daltons, wherein i) V units are terminal units having the formula:

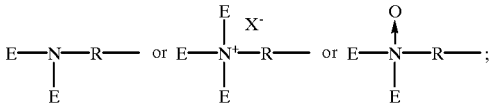

ii) W units are backbone units having the formula:

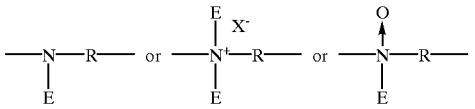

iii) Y units are branching units having the formula:

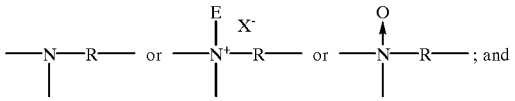

iv) Z units are terminal units having the formula:

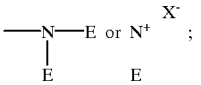

wherein backbone linking R units are selected from the group consisting of $C_2$–$C_{12}$ alkylene, $C_4$–$C_{12}$ alkenylene, $C_3$–$C_{12}$ hydroxyalkylene, $C_4$–$C_{12}$ dihydroxy-alkylene, $C_8$–$C_{12}$ dialkylarylene, —$(R^1O)_xR^1$—, —$(R^1O)_xR^5(OR^1)_x$—, —$(CH_2CH(OR^2)CH_2O)_z(R^1O)_yR^1(OCH_2CH(OR^2)CH_2)_w$—, —$C(O)(R^4)_rC(O)$—, —$CH_2CH(OR^2)CH_2$—, and mixtures thereof; wherein $R^1$ is $C_2$–$C_6$ alkylene and mixtures thereof; $R^2$ is hydrogen, —$(R^1O)_xB$, and mixtures thereof; $R^3$ is $C_1$–$C_{18}$ alkyl, $C_7$–$C_{12}$ arylalkyl, $C_7C_{12}$ alkyl substituted aryl, $C_6$–$C_{12}$ aryl, and mixtures thereof; $R^4$ is $C_1$–$C_{12}$ alkylene, $C_4$–$C_{12}$ alkenylene, $C_8$–$C_{12}$ arylalkylene, $C_6$–$C_{10}$ arylene, and mixtures thereof; $R^5$ is $C_1$–$C_{12}$ alkylene, $C_3$–$C_{12}$ hydroxyalkylene, $C_4$–$C_{12}$ dihydroxy-alkylene, $C_8$–$C_{12}$ dialkylarylene, —C(O)—, —$C(O)NHR^6NHC(O)$—, —$R^1(OR^1)$—, —$C(O)(R^4)_rC(O)$—, $CH_2CH(OH)CH_2$—, —$CH_2CH(OH)CH_2O(R^1O)_yR^1OCH_2CH(OH)CH_2$—, and mixtures thereof; $R^6$ is $C_2$–$C_{12}$ alkylene or $C_6$–$C_{12}$ arylene; E units are selected from the group consisting of hydrogen, $C_1$–$C_{22}$ alkyl, $C_3$–$C_{22}$ alkenyl, $C_7$–$C_{22}$ arylalkyl, $C_2$–$C_{22}$ hydroxyalkyl, —$(CH_2)_pCO_2M$, —$(CH_2)_qSO_3M$, —$CH(CH_2CO_2M)CO_2M$, —$(CH_2)_pPO_3M$, —$(R^1O)_xB$, —$C(O)R^3$, and mixtures thereof; oxide: B is hydrogen, $C_1$–$C_6$ alkyl, —$(CH_2)_qSO_3M$, —$(CH_2)_pCO_2M$, —$(CH_2)_q(CHSO_3M)CH_2SO_3M$, —$(CH_2)_q$—$(CHSO_2M)CH_2SO_3M$, —$(CH_2)_pPO_3M$, —$PO_3M$, and mixtures thereof; M is hydrogen or a water soluble cation in sufficient amount to satisfy charge balance; X is a water soluble anion; m has the value from 4 to about 400; n has the value from 0 to about 200; p has the value from 1 to 6, q has the value from 0 to 6; r has the value of 0 or 1; w has the value 0 or 1; x has the value from 1 to 100; y has the value from 0 to 100; z has the value 0 or 1. One example of the most preferred polyethyieneimines would be a polyethyleneimine having a molecular weight of 1800 which is further modified by ethoxylation to a degree of approximately 7 ethyleneoxy residues per nitrogen (PEI 1800, E7). It is preferable for the above polymer solution to be pre-complex with anionic surfactant such as NaLAS.

Other preferable examples of the aqueous or non-aqueous polymer solutions which can be used as liquid polymers in the present inventions are polymeric polycarboxylate dispersants which can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Homo-polymeric polycarboxylates which have molecular weights above 4000, such as described next are preferred. Particularly suitable homo-polymeric polycarboxylates can be derived from acrylic acid. Such acrylic acid-based polymers which are useful herein are the water-soluble salts of polymerized acrylic acid. The average molecular weight of such polymers in the acid form preferably ranges from above 4,000 to 10,000, preferably from above 4,000 to 7,000, and most preferably from above 4,000 to 5,000. Water-soluble salts of such acrylic acid polymers can include, for example, the alkali metal, ammonium and substituted ammonium salts.

Co-polymeric polycarboxylates such as an acrylic/maleic-based copolymers may also be used. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. It is preferable for the above polymer solution to be pre-complexed with anionic surfactant such as LAS.

Adjunct Detergent Ingredients

The starting detergent material in the present process can include additional detergent ingredients and/or, any number of additional ingredients can be incorporated in the detergent composition during subsequent steps of the present process. These adjunct ingredients include other detergency builders, bleaches, bleach activators, suds boosters or suds suppressors, anti-tarnish and anticorrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Other builders can be generally selected from the various water-soluble, alkali metal, ammonium or substituted ammonium phosphates, polyphosphates, phosphonates, polyphosphonates, carbonates, borates, polyhydroxy sulfonates, polyacetates, carboxylates, and polycarboxylates. Preferred are the alkali metal, especially sodium, salts of the above. Preferred for use herein are the phosphates, carbonates, $C_{10-18}$ fatty acids, polycarboxylates, and mixtures thereof. More preferred are sodium tripolyphosphate, tetrasodium pyrophosphate, citrate, tartrate mono- and di-succinates, and mixtures thereof.

Bleaching agents and activators are described in U.S. Pat. No. 4,412,934, Chung et al., issued Nov. 1, 1983, and in U.S. Pat. No. 4,483,781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and U.S. Pat. No. 4,136,045, issued Jan. 23, 1979 to Gault et al., both incorporated herein by reference.

Suitable smectite clays for use herein are described in U.S. Pat. No. 4,762,645, Tucker et al, issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al, issued May 5, 1987, both incorporated herein by reference.

Optional Process Steps

One optional step after the second step of the present invention is an additional agglomeration process. The examples which can be used as the additional process are described in such as U.S. Pat. No. 5,486,303, U.S. Pat. No. 5,516,448, U.S. Pat. No. 5,554,587 and U.S. Pat. No. 5,574,005.

Other optional step in the process is drying, if it is desired to reduce level of moisture from the present process. This can be accomplished by a variety of apparatus, well known to these skilled in the art. Fluid bed apparatus is preferred, and will be referred to in the discussion which follows.

In other optional step of the present process, the detergent granules exiting the fluid bed dryer are further conditioned by additional cooling in cooling apparatus. The preferred apparatus is a fluid bed. Another optional process step involves adding a coating agent to improve flowability in one or more of the following locations of the instant process. The coating agent is preferably selected from the group consisting of aluminosilicates, silicates, carbonates and mixtures thereof. The coating agent not only enhances the free flowability of the resulting detergent composition which is desirable by consumers in that it permits easy scooping for detergent during use, but also serves to control agglomeration by preventing or minimizing over agglomeration, especially when added directly to the moderate speed mixer. As those skilled in the art are well aware, over agglomeration can lead to very undesirable flow properties and aesthetics of the final detergent product.

Optionally, the process can comprise the step of spraying an additional binder in the process for the present invention or fluid bed dryers and/or fluid bed coolers. A binder is added for purposes of enhancing agglomeration by providing a "binding" or "sticking" agent for the detergent components. The binder is preferably selected from the group consisting of water, anionic surfactants, nonionic surfactants, liquid silicates, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Other optional steps contemplated by the present process include screening the oversized detergent granules, whose amount is minimized by the present process, in a screening apparatus which can take a variety of forms including but not limited to conventional screens chosen for the desired particle size of the finished detergent product.

Another optional step of the instant process entails finishing the resulting detergent agglomerates by a variety of processes including spraying and/or admixing other conventional detergent ingredients. For example, the finishing step encompasses spraying perfumes, brighteners and enzymes onto the finished agglomerates to provide a more complete detergent composition. Such techniques and ingredients are well known in the art.

The other optional step in the process involves high active paste structuring process, e.g., hardening an aqueous anionic surfactant paste by incorporating a paste-hardening material by using an extruder, prior to the process of the present invention. The details of the high active paste structuring process is disclosed application No. PCT/US96/15960 (filed Oct. 4,1996).

In order to make the present invention more readily understood, reference is made to the following examples, which are intended to be illustrative only and not intended to be limiting in scope.

EXAMPLES

Example 1

The following is an example* (*: batch size) for obtaining agglomerates using a bench scale sized Lodige CB mixer (hereinafter, CB mixer).

232 g of CFAS (coconut fatty alcohol sulfate, $C_{12}$–$C_{18}$) paste (72% active) is dispersed by the pin tools of a CB mixer for 7.25 seconds, along with 179 g of powdered STPP (mean particle size of 40–75 microns), 119 of ground soda ash (mean particle size of 10–20 microns), 92 g of sodium sulfate (mean particle size of 70–120 microns), 37 of zeolite and 140 of recycle fines. After a short interval (1–2 seconds), 26 g of $AE_3S$ (alkyl ethoxy sulfate, C12–C15) paste (70% active) is dispersed by the pin tools of the CB mixer for about 1 second. After the addition of $AE_3S$ paste, the contents in the CB mixer are mixed for about 3 seconds in order to obtain free-flowing agglomerates.

The condition of the CB mixer is as follows:

Mixer speed : 800 rpm

Paste temperature: 45–47° C.

Jacket temperature: 30° C.

Pin length: 18.9 cm

Diameter of the mixer: 20 cm

The agglomerate from the CB mixer has free-flowing, density of 640–700 g/l. The agglomerates includes only 5.2% of oversized (i.e., larger than 1180 $\mu$m m) granules.

Example 2

The following is an example* (*: batch size) for obtaining agglomerates using a bench scale sized Lödige CB mixer (hereinafter, CB mixer), followed by bench scale sized L ödige KM mixer (hereinafter, KM mixer).

234 g of CFAS (coconut fatty alcohol sulfate, $C_{12}$–$C_{18}$) paste (72% active) is dispersed by the pin tools of a CB mixer for 7.5 seconds, along with 197 g of powdered STPP (mean particle size of about 40–75 microns), 152 g of ground soda ash (mean particle size of about 10–20 microns), 66 g of sodium sulfate (mean particle size of about 10–20 microns) and 136 g of recycle fines. The contents in the CB mixer are mixed for about 4 seconds in order to obtain free-flowing agglomerates. The conditions of the CB-30 mixers are as follows.

Mixer speed: 800 rpm

Paste temperature: 45–47° C.

Jacket temperature: 30° C.

Pin length: 18.9 cm

Diameter of the mixer: 20 cm 750 g of the agglomerates from the CB mixer is added to the KM mixer. 29 g of acid precursor of LAS (linear alkyl benzene sulfonate, $C_{18}$ (=average)) at 50–60° C. is added to a KM mixer for about 1.5 seconds. After the addition of acid precursor of LAS, 8 g bf zeolite (mean particle size of about 4–7 microns) and 50 g of ground soda ash (mean particle size of about 10–20 microns) is added. The contents are mixed in the KM mixer for 4–5 seconds, for the purpose of particle growth. In this mixing step, optionally, one or more conventional choppers can be attached into the KM mixer.

The conditions of the KM mixer are as follows:

Mixer speed: 150 rpm

Jacket temperature : 35° C.

The agglomerates obtained from the KM mixer are dried in a batch scale fluid bed dryer at 95° C. for 3 minutes, and subsequently cooled in a batch scale fluid bed cooler.

The agglomerates from the cooler are free-flowing with a cake strength of about 0.7 kgf, and has density of 750–800 g/l. The mean particle size of agglomerates is about 400–500 $\mu$m. The agglomerates includes about 20% of unacceptable oversized (i.e., larger than 1180 $\mu$m) agglomerates.

Example 3

The following is an example for obtaining agglomerates using Lödige CB-30 mixer (hereinafter, CB mixer), followed by Lödige KM-600 mixer (hereinafter, KM mixer).

340 kg/hr of CFAS (coconut fatty alcohol sulfate, $C_{12}$–$C_{18}$) paste (72% active) is dispersed by the pin tools of a CB mixer along with 250 kg/hr of powdered STPP (mean particle size of about 40–75 microns), 185 kg/hr of ground soda ash (mean particle size of about 10–20 microns), 195 kg/hr of ground sulfate (mean particle size of about 10–20 microns), 200 kg/hr of recycle fines and 11 kg/hr of zeolite. The conditions of the CB-30 mixer are as follows.

Mixer speed : 620 rpm

Paste temperature: 45–48° C.

Jacket temperature: 30° C.

Pin length : 28.9 cm

Diameter of the mixer: 30 cm

Retention time : 7–15 seconds

Energy condition of the Mixer: 2.1 kj/kg

The agglomerates from the CB mixer is added to the KM mixer. 37 kg/hr of $AE_3S$ (alkyl ethoxy sulfate, $C_{12}$–$C_{15}$) paste (70% active) is dispersed to KM mixer by the pin tools of the CB mixer. 5–10 kg/hr of Zeolite is added to the KM mixer. In the mixing step in KM mixer, conventional choppers (4 numbers of "Christmas Tree Choppers") can be attached into the KM mixer.

The conditions of the KM mixer are as follows:

Mixer speed: 100 rpm

Jacket temperature : 40° C.

Retention time: 2.0–6.0 minutes

Energy condition of the Mixer: 1.5–3.0 kj/kg

Condition of choppers: 1,600 rpm

The agglomerates obtained from the KM mixer has only about 2–10% of unacceptable oversized (i.e., larger than 1180 $\mu$m) agglomerates. The agglomerates from the KM mixer (having diameter not larger than 1180 $\mu$m) are dried in a fluid bed dryer at 95° C., and subsequently cooled at 10–12 ° C. in a fluid bed cooler.

The agglomerates from the cooler are free-flowing, and has density of 750–850 g/l. The mean particle size of agglomerates is about 500–650 $\mu$m.

Having thus described the invention in detail, it will be obvious to those skilled in the art that various changes may be made without departing from the scope of the invention and the invention is not to be considered limited to what is described in the specification.

What is claimed is:

1. A process for preparing a granular detergent composition comprising:

(a) thoroughly mixing a crystalline anionic surfactant paste selected from the group consisting of $C_{12}$–$C_{18}$ coconut fatty alcohol sulfates, $C_{14}C_{15}$ synthetic alkyl sulfates and mixtures thereof, with a sufficient amount of fine powders selected from the group consisting of soda ash, sodium sulphates, aluminosilicates, crystalline layered silicates, phosphates, precipitated silicates, polymers, carbonates, citrates, nitrilotriacetates, powdered surfactants, recycle fines of fine powders and/or free flowing agglomerates and mixtures thereof, to form a free flowing agglomerate;

(b) thoroughly mixing a product of the step (a) with a non-crystalline anionic surfactant paste selected from the group consisting of alkyl ethoxy sulfates, alkyl benzene sulfonates and mixtures thereof, to form a free flowing agglomerate, wherein the agglomerate from step (b) includes less than about 20% of granules having a diameter larger than 1180 $\mu$m.

2. A granular detergent composition made according to the process of claim 1.

* * * * *